US009097062B2

(12) United States Patent
Letonje et al.

(10) Patent No.: US 9,097,062 B2
(45) Date of Patent: Aug. 4, 2015

(54) LIFTING DOOR HAVING A MOVABLE DOOR-LEAF GUIDE

(75) Inventors: Jure Letonje, Menges (SI); Andrej Mazej, Vodice (SI); Janez Küzmic, Litija (SI)

(73) Assignee: Efaflex Inzeniring D.O.O. Ljubljana, Ljublana (SI)

( * ) Notice: Subject to any disclaimer, the term of this patent is extended or adjusted under 35 U.S.C. 154(b) by 0 days.

(21) Appl. No.: 13/580,592

(22) PCT Filed: Jan. 19, 2011

(86) PCT No.: PCT/EP2011/000202

§ 371 (c)(1),
(2), (4) Date: Aug. 22, 2012

(87) PCT Pub. No.: WO2011/103946

PCT Pub. Date: Sep. 1, 2011

(65) Prior Publication Data

US 2012/0312483 A1 Dec. 13, 2012

(30) Foreign Application Priority Data

Feb. 25, 2010 (DE) ..... 10 2010 000 556

(51) Int. Cl.
*E06B 9/92* (2006.01)
*E06B 9/58* (2006.01)
(Continued)

(52) U.S. Cl.
CPC ... *E06B 9/58* (2013.01); *E06B 9/15* (2013.01); *E06B 7/16* (2013.01); *E06B 9/92* (2013.01); *E06B 2009/588* (2013.01)

(58) Field of Classification Search
CPC ..... E06B 9/92; E06B 2009/588
USPC ..... 160/133, 209, 41, 40; 49/212
See application file for complete search history.

(56) References Cited

U.S. PATENT DOCUMENTS 423,739 A * 3/1890 Cook ..... 49/212
822,130 A * 5/1906 Hussey ..... 49/212
(Continued)

FOREIGN PATENT DOCUMENTS

CA 2436381 A1 1/2005
CN 101939502 A 1/2011
(Continued)

OTHER PUBLICATIONS

English Translation of International Preliminary Report on Patentability and Written Opinion, International Patent Application No. PCT/EP2011/000202, date of Aug. 28, 2012, 12 pages.
(Continued)

*Primary Examiner* — David Purol
(74) *Attorney, Agent, or Firm* — Fitch, Even, Tabin & Flannery LLP

(57) ABSTRACT

The invention relates to a lifting door comprising a movable door leaf formed by slats pivotally connected to each other and building-mounted frames. On the latter lateral guides for the door leaf having a vertical section and a lintel section, as well as a frame seal, which in the closed condition of the lifting door closes a gap between the door leaf and a section of the frames facing the door opening. The vertical sections of the guides are mounted on the frames so as to be displaceable perpendicularly to the plane of the door leaf and fixed in the direction of movement of the door leaf. The invention further relates to a frame and a guide as well as a corresponding method.

15 Claims, 8 Drawing Sheets

(51) Int. Cl.
*E06B 9/15* (2006.01)
*E06B 7/16* (2006.01)

(56) References Cited

U.S. PATENT DOCUMENTS

| | | | | | |
|---|---|---|---|---|---|
| 1,869,347 | A | | 7/1932 | Johnson | |
| 2,069,665 | A | * | 2/1937 | Bouthillier | 160/195 |
| 2,166,746 | A | * | 7/1939 | Bartel | 160/191 |
| 2,749,582 | A | * | 6/1956 | Beck | 160/40 |
| 2,820,516 | A | * | 1/1958 | Cookson, Jr. et al. | 160/40 |
| 2,827,114 | A | * | 3/1958 | Stroup | 160/209 |
| 2,855,989 | A | * | 10/1958 | Pritchard | 160/40 |
| 3,027,937 | A | * | 4/1962 | Wilson | 160/40 |
| 3,034,575 | A | * | 5/1962 | Stroup | 160/40 |
| 3,331,158 | A | * | 7/1967 | Frakes | 49/310 |
| 3,947,998 | A | | 4/1976 | Matsubara | |
| 4,119,133 | A | * | 10/1978 | Wolf | 160/209 |
| 4,250,941 | A | * | 2/1981 | McNally | 160/209 |
| 4,320,793 | A | * | 3/1982 | Lindbergh | 160/201 |
| 4,880,046 | A | * | 11/1989 | Gesy | 160/194 |
| 5,277,240 | A | * | 1/1994 | Epema et al. | 160/188 |
| 5,394,924 | A | * | 3/1995 | Rejc | 160/201 |
| 5,402,841 | A | * | 4/1995 | Tierney | 160/195 |
| 5,484,007 | A | * | 1/1996 | Rejc | 160/133 |
| 5,488,982 | A | * | 2/1996 | Rejc | 160/133 |
| 6,123,139 | A | * | 9/2000 | Kalempa et al. | 160/188 |
| 2011/0030278 | A1 | | 2/2011 | Breznikar et al. | |
| 2014/0246157 | A1 | | 9/2014 | Letonje et al. | |

FOREIGN PATENT DOCUMENTS

| | | | |
|---|---|---|---|
| DE | 4015214 | A1 | 11/1991 |
| DE | 19715295 | A1 | 10/1997 |
| DE | 19915376 | A1 | 10/2000 |
| DE | 20206188 | U1 | 8/2003 |
| DE | 10324084 | A | 12/2003 |
| DE | 202004000679 | U1 | 4/2004 |
| DE | 10300302 | A1 | 7/2004 |
| DE | 102008007592 | A | 8/2009 |
| EP | 0769605 | A2 | 4/1997 |
| EP | 0769605 | B1 | 5/2003 |
| JP | 2000-170461 | A | 6/2000 |
| JP | 2002-097864 | A | 4/2002 |
| JP | 2003-253976 | A | 9/2003 |
| JP | 2003-343172 | A | 12/2003 |
| WO | 2007045423 | A1 | 4/2007 |
| WO | 2013017209 | A1 | 2/2013 |

OTHER PUBLICATIONS

International Search Report, International Patent Application No. PCT/EP2011/000202, date of actual completion of the international search Feb. 25, 2011, 2 pages.

International Search Report, International Patent Application No. PCT/EP2012/003043, date of actual completion of the international search Dec. 20, 2012, 2 pages.

Chinese Office Action for Application No. 201180011466.6, dated Jun. 26, 2014, 18 pages.

* cited by examiner

LIFTING DOOR HAVING A MOVABLE DOOR-LEAF GUIDE

CROSS REFERENCE TO RELATED APPLICATIONS

This application is a national phase application of International Application No. PCT/EP2011/000202, filed Jan. 19, 2011, designating the United States and claiming priority to German Patent Application No. 10 2010 000 556.8, filed Feb. 25, 2010, both of which are incorporated by reference herein in their entirety.

DESCRIPTION

The invention relates to a lifting door comprising a movable door leaf and building-mounted frames disposed on either side of a door opening, wherein mutually facing, lateral guides for the door leaf each comprising a vertical section and a lintel section are arranged at the frames, wherein the door leaf is formed of slats pivotally connected to each other and in the closed condition covers the door opening, wherein the door leaf is guided in the lateral guides such as to be accommodated in the lintel sections in the opened state of the lifting door and in the vertical sections of the guides in the closed condition of the lifting door, wherein the vertical sections of the guides are mounted on the frames so as to be displaceable, whereby in the closed condition of the lifting door the door leaf may be displaced in a direction toward the outer side of the door, and wherein a driver means is arranged at the door leaf which allows to create the displacement of the vertical sections at the frames due to the movement of the door leaf.

A lifting door having the form of a fast-moving industrial door or gate has become known, e.g., from DE 199 15 376 A1. There, the door leaf is realized in the manner of a segmented armor, with the individual slats being pivotally connected to each other and guided in lateral guides. The guides each comprise a vertical section and a spiral section, with the latter being arranged in the lintel area of the lifting door. The door leaf is guided in the lateral guides by means of moving rollers, with the axes of rotation of the latter coinciding with the pivotal axes of the individual slats. At the side of the moving rollers facing away from the door leaf there is furthermore arranged a collar whereby an indirect form-fit reception of the lateral edges of the door leaf in the lateral guides is provided. This known rolling door is characterized by very high moving speeds of up to 4 m/s during opening and closing and by low-noise and low-energy operation. In addition it provides a genuine closure of the door opening.

In the rolling door according to DE 199 15 376 A1, sealing of the moving gap between the door leaf and the door opening is effected by means of lip seals. These are fastened to the frames and contact the two major surfaces of the door leaf, to thereby close the respective moving gap present there. Although this sealing system has been found to be quite acceptable in practice it appears to allow for improvements. In particular such lip seals are subject to considerable wear because the door leaf fret slides along them during opening and closing at a high moving speed, which results in abrasion particularly at the sealing elements. This is equally true for other sealing system employing, e.g., brush sealing systems instead of the lip seals. These sealing elements must therefore be replaced at predetermined intervals.

Such rolling doors as are known from DE 199 15 376 A1 are moreover also employed for special purposes such as, e.g., as a deep-freeze store door, clean-room door, fire protection door, as a door closure in pharmaceutical companies, or the like. From these special applications there results a particular need for reliable and durable sealing of the moving gaps between the door leaf and the door opening, which is then of particular importance at the outer side of the door.

From DE 103 00 302 A1 and from U.S. Pat. No. 2,069,665 lifting doors have moreover become known wherein the lateral guides are split such that the vertical sections may be pivoted relative to the lintel sections. In the open position of the lifting door the vertical section is present at such an inclination with the door opening plane that it is further spaced apart from it at the upper end of the door opening than at the lower end. During the closing movement of the door leaf the latter then acts on a frame-side actuation means, whereby the upper ends of the vertical sections are pivoted are pivoted in a direction toward the door opening. As a result, the door leaf then rests against the frames, or the sealing elements possibly arranged there, and closes the gap between the door leaf and the door opening.

It is, however, a drawback in such lifting door systems that at any rate the sealing elements in the lower area of the door opening continue to be subjected to considerable abrasion by the door leaf sliding along there. The sealing elements provided there thus are not abraded over their entire length, but invariably continue to be worn considerably in the lower area in which a reliable sealing effect can therefore not be obtained.

From U.S. Pat. No. 1,869,347, finally, a lifting door arrangement has become known where the vertical section of the guides is displaced in parallel in a direction toward the door opening during the closing movement of the door leaf. Here the displacement movement is introduced in that the lower termination shield of the door leaf contacts the lower ends of the vertical sections on either side to then drive the latter, due to the own weight of the door leaf, for some distance as far as the complete closing position. Here the vertical sections are each moved away from the associated lintel section of the guides via an oblique sliding guide, both vertically and horizontally against a spring bias. The door leaf then contacts the frames of the door opening to create a more or less tight closure there. Sealing elements are apparently not provided in this case. Finally, during the opening movement, the load at the lower end of the vertical sections of either side is then cancelled, so that the latter again move back into their starting position and are aligned with the lintel sections so that the door leaf may be moved into them.

It is a drawback of this lifting door that in the last portion of the closing movement the door leaf executes a sliding movement at the frame elements of the door opening. This results in a considerable abrasion of the door leaf across its entire height. As a manual actuation is apparently provided in the case of this known lifting door, this seems to be acceptable because of the low moving velocity. Such a lifting door is, however, not suitable for fast-moving operation.

In addition the spring means utilized for returning the vertical section is subject to considerable wear as it has to lift the own weight of the vertical section of the two guides during every opening movement. A particular problem in this connection is that when the spring force deteriorates, it is not ensured any more that an aligned connection to the lintel section will be obtained in a reliable manner. The door leaf can then not be moved smoothly into the lintel section, with the consequence of damage to the door leaf and problems during operation of the lifting door.

The invention is therefore based on the object of further developing a generic lifting door in such a way that it may be utilized with higher reliability and at higher moving velocities at a concurrently improved sealing effect between the door leaf and the door opening.

This object is achieved through a lifting door having the features of claim 1. The latter is characterized in particular through the fact that the lifting door further comprises a drive unit for operating the door leaf, that frame sealing elements of a sealing means are furthermore arranged at the frames, which in the closed condition of the lifting door close a gap between the door leaf and a section of the frames facing the door opening, wherein in the closed condition of the lifting door the door leaf presses against the sealing means in a direction toward the outer side of the door, that the driver means cooperates with a frame-side actuation means which initiates the displacement of the frames via displacement mechanisms, and that the vertical sections of the guides are mounted on the frames so as to be displaceable perpendicularly to the plane of the door leaf and fixed in the direction of movement of the door leaf.

In the framework of the invention it was realized that the sealing effect may already be improved by modifying the interaction of the door leaf with the sealing means in a particular manner. In this regard the invention provides for the first time to form the vertical sections of the guides at the door arrangement in a manner to be movable only perpendicularly to the plane of the door leaf, i.e., to utilize a purely linear horizontal displacement.

Here it was further realized in the framework of the invention that due to its accommodation in the vertical sections of the guides, the door leaf has the comportment of a rigid panel, thus enabling an effective transmission of force perpendicularly to the plane of the door leaf. Accordingly it is possible in accordance with the invention, despite the door leaf structure of slats adapted to be pivoted relative to each other, to urge the door leaf against the sealing means in a direction toward the outer side of the door in the manner of a rigid member.

This allows to obtain an extraordinarily reliable sealing effect inasmuch as the sealing means may unfold its efficiency particularly well as a result of the exerted pressure. In this way it is achieved that the door leaf contacts the sealing means more accurately and reliably than in the prior art.

The sealing means of the lifting door in accordance with the invention is acted on only perpendicularly to its longitudinal extension and not by a movement sliding along there as in the prior art. It is therefore subjected to lower wear and accordingly achieves a longer service live than those in the prior art. Hereby it is possible to achieve a lifting door which is particularly well sealed and is particularly durable and reliable even with regard to the sealing means.

Thus it is possible to do away with a sliding sealing means, whereby a particularly long service life may be attained for the latter. Moreover this results in the advantage of a particularly high freedom of design with a view to the material of the sealing means, for more suitable sealing materials and sealing shapes are typically available for urged seals than for sliding seals.

It is advantageous that a driver means is arranged at the door leaf which cooperates directly with the frame-side actuation means and which allows to create the displacement of the vertical sections at the frames due to the movement of the door leaf. This process may then be automated with low technological complexity while at the same time ensuring that this displacement will ensue only when the door leaf has securely moved out from the lintel sections of the guides and has entered completely into the vertical sections, i.e., when it has already passed between these sections of the guides. Hereby it is possible to obtain a very reliable lifting door arrangement at particularly low constructional complexity.

As the relative movement of the two frame sections only takes place horizontally, this moreover results in a very low susceptance to failure of the lifting door of the invention. Here it is continuously readily possible to establish an aligned connection between vertical section and horizontal section of a respective guide during the movement of the lifting door.

Moreover the lifting door of the invention permits a reliable fast-moving operation, which is as a general rule desired for industrial applications.

Advantageous developments of the lifting door of the invention are subject matter of appended claims 2 to 6.

Thus it is possible for the driver means to be a door leaf reception which is arranged in the area of a termination element of the door leaf and introduces the driving force of the drive unit to the door leaf. Hereby the invention may be realized with particularly low constructional complexity as such a door leaf reception at any rate already exists in most conventional lifting doors. In particular it is possible, without constructional adaptation of the door leaf reception or at any rate with only a very minor constructional adaptation, to utilize it as a driver means. Moreover the driving force of the drive unit is hereby utilized particularly effectively for introducing the displacing movement of the vertical sections at the frames.

In accordance with one design variant the actuation means may initiate the displacement of the vertical sections of the guides via displacement mechanisms, with at least two, preferably at least three and in particular more than four displacement mechanisms being present on each side of the door. Thus, the concurrent introduction of a force for displacing the vertical sections of the guides toward the outer side of the door is moreover enabled in several locations across the height of the door leaf. Jamming of the vertical sections of the guides may thus reliably be suppressed as their movement takes place concurrently across the entire longitudinal extension of the vertical sections in the sense of a horizontal displacement. Accordingly, at least two displacement mechanisms are arranged on each side of the door, which attack at least in the respective upper and lower areas of the vertical sections of the guides. Depending on the height of the door it may, however, also be expedient to provide three, four, or even more displacement mechanisms at each side of the door in order to achieve homogeneous urging of the door leaf, which is received and thus concurrently moved in the vertical sections of the guides, against the sealing means. Especially for door heights of more than five meters it is mostly expedient to employ more than four displacement mechanisms at each side of the door. The actuation means is preferably realized as an actuation rod which cooperates with the displacement mechanisms and allows for a simultaneous actuation of the latter. Hereby a reliable operating manner is obtained with simple technological means.

Alternatively it is also possible for the driver means to comprise actuation receptions fastened on both sides at the top and bottom ends of the door leaf, in which frame-side mounted guide rollers engage so as to produce the displacement of the vertical sections at the frames during the process of closing the door leaf. This design variant is characterized by particularly low constructive complexity, for it is then possible to do away with an actuation rod in each frame, etc. Nevertheless, in this case an introduction of force is typically only provided at the top and bottom ends of the door leaf. Hereby the vertical sections of the guides are displaced indirectly via the displacing movement of the sealing means of the door leaf in a direction toward the outer side of the door.

Particularly in cases of lifting doors comprising door leafs having a comparatively low height, this alternative realization of a driver means does, however, represent a cost-efficient and practicable variant.

In another alternative it is possible for the actuation means to be a control unit which controls a separate drive means whereby the displacement of the vertical sections at the frames may be produced following the termination of the closing movement of the door leaf. This design variant requires the least complexity of constructional modification at the door leaf or door leaf drive and may moreover be realized through means that are very reliable in terms of control technology and through simple means. In the area of each frame the separate drive means comprises at least two, preferably at least three and particularly more than four actuation members which produce the displacement of the vertical sections at the frames. In this design variant, as well, the number of actuation members has to be selected as a general rule with a view to the existing door height of the lifting door in accordance with the invention, where it may be assumed that a greater door height generally will involve a larger number of actuation members.

The sealing means may further comprise a lintel sealing element which is arranged in the door lintel area and closes a moving gap present there between the door lintel and the door leaf when the door leaf is in the displaced condition. Hereby the sealing effect at the lifting door of the invention may be improved even further. In particular it is also possible for the lintel sealing element to be connected to the lateral frame sealing elements, whereby a gap in the abutting area of these sealing elements may be avoided. The lintel sealing element and the two frame sealing elements may then be formed integrally, for example in the form of a tube seal, or may also be welded or adhesively bonded to each other at the abutting ends.

In accordance with another aspect of the present invention according to claim 7, a frame for a lifting door in accordance with the invention is provided which comprises a guide for a door leaf having a vertical section and a lintel section, as well a frame sealing element of a sealing means which, in the closed condition of the lifting door, closes a gap between the door leaf and a section of the frame facing the door opening. This frame is characterized by the fact that the vertical section of the guide is mounted at the frames so as to be displaceable perpendicularly to the plane of the door leaf and fixed in the direction of movement of the door leaf.

By means of this frame it is possible to analogously obtain the advantages explained in the foregoing with regard to the lifting door of the invention. The frame then furthermore constitutes a retrofitting or refitting part for conventional lifting doors, whereby the latter may be improved in the manner of the present invention.

The frame in accordance with the invention may be developed further by the corresponding detail features of appended claims 3 to 5, whereby the advantages explained in the foregoing are equally made possible.

In accordance with a still further aspect of the present invention according to claim 9, a guide for a lifting door in accordance with the invention is provided wherein a door leaf of the lifting door may be guided and which comprises a vertical section and a lintel section. This guide is characterized by the fact that the vertical section is adapted to be displaced laterally relative to the lintel section.

This guide also constitutes a retrofitting or refitting part for conventional frames or lifting doors and thus allows to obtain the advantages explained in the foregoing.

In accordance with a still further aspect of the present invention according to claim 10, a method for closing a gap at a lifting door is proposed which may be applied in a particularly advantageous manner at the lifting door of the invention. This method is characterized by the following steps: moving the door leaf into its closing position, and displacing the vertical sections of the guides perpendicularly to the plane of the door leaf during the closing movement or after it in a direction toward the outer side of the door, without a movement of the vertical sections in the direction of movement of the door leaf, whereby the door leaf is urged against the sealing means.

Due to this method in accordance with the invention it is advantageously possible to produce an improved sealing effect between the door leaf and the door opening, with furthermore very low wear occurring at the sealing means. The method in accordance with the invention therefore results in a particularly long-lived and reliable utilization of a lifting door in accordance with the invention even at high movement velocities of, e.g., 3 m/s.

The lifting door of the invention shall in the following be explained in more detail through practical examples while making reference to the figures of the drawing, wherein.

Figure 1:
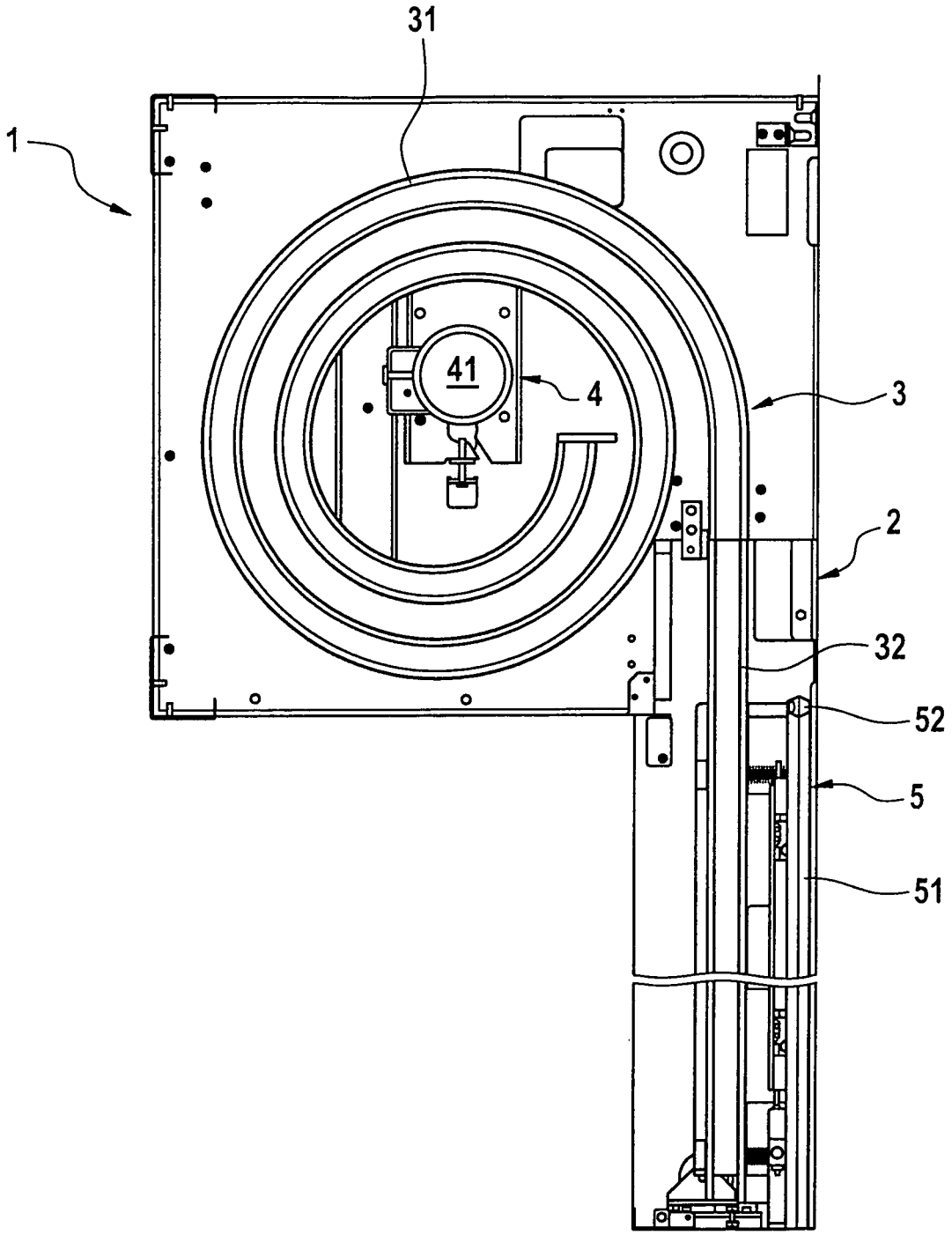
FIG. 1 is a lateral view onto the area of a frame of a lifting door in accordance with the invention, with the door leaf being left away for the sake of clarity and the shown vertical section of the guide being present in its basic position for the operation of the door leaf.

In accordance with the representation in FIG. 1, a lifting door 1 comprises a frame 2 having a guide 3 for a door leaf which is not shown in this figure. FIG. 1 shows the view of a left-hand frame 2 when looking out through the door opening. In the subsequent description mostly only the area of one door side shall be discussed, wile a frame arrangement including guide etc. and formed accordingly in mirror symmetry is present on the other side of the door opening. The lifting door 1 further comprises a drive unit 4 including a motor 41 as well as a sealing means 5.

The guide 3 contains a lintel section 31 which in the present practical example has the form of a spiral. In the opened state of the lifting door 1 the door leaf is received therein in a non-contacting coil in the door lintel area. The guide 3 further contains a vertical section 32 in which the door leaf is present in the closed condition of the lifting door 1. At the opposite frame of the door opening a guide formed in mirror symmetry is arranged.

The vertical section 32 is displaceable relative to the lintel section 31, and to this end is mounted on the frame 2 in a horizontally displaceable manner. FIG. 1 shows the state in which the lintel section 31 and the vertical section 32 are aligned with each other, so that the door leaf may be moved from one area into the other one.

Figure 2:
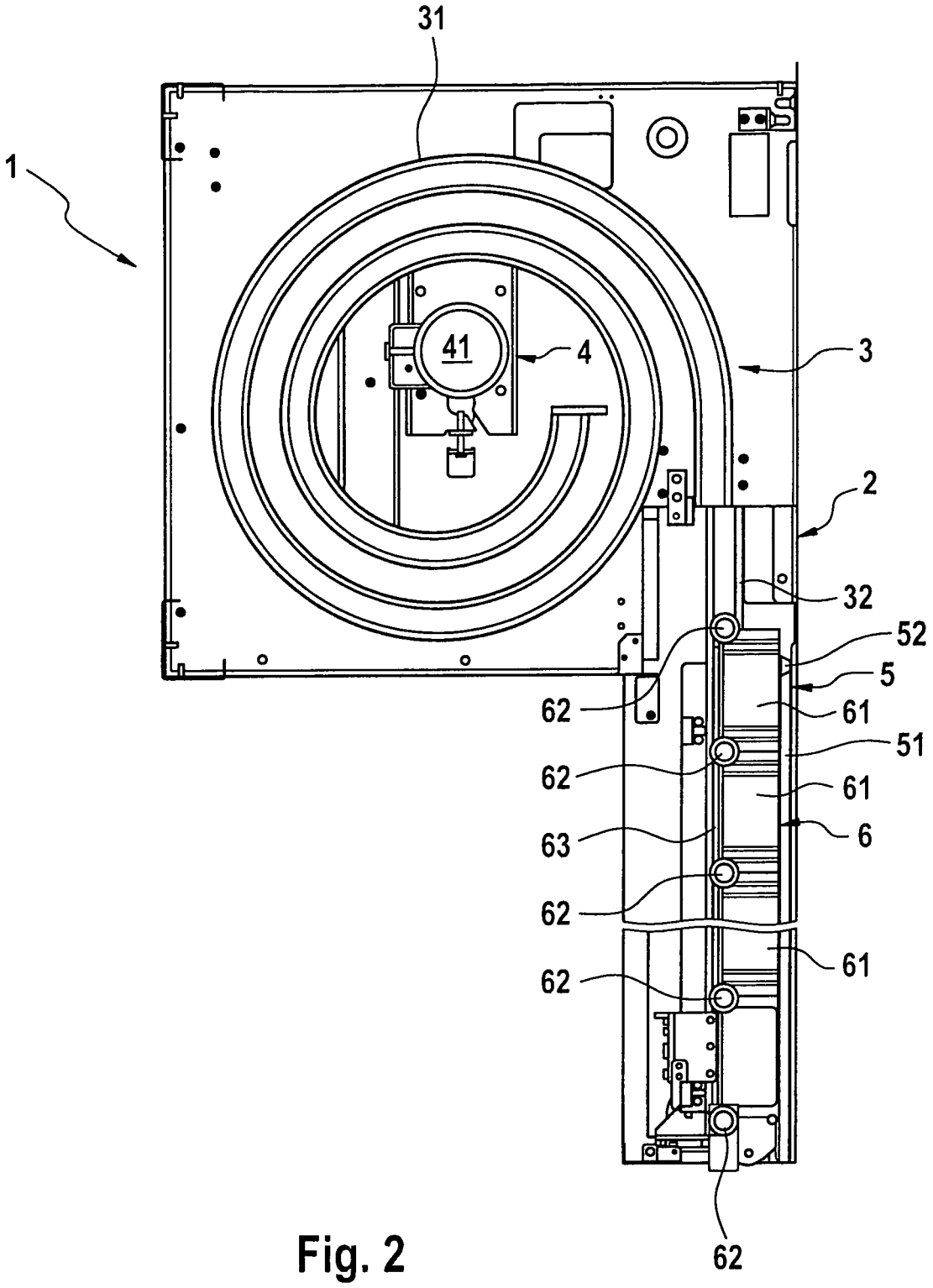
FIG. 2 is a view modified in comparison with FIG. 1 in that the vertical section of the guide is displaced in a direction toward the outer side of the door, with the door leaf also being represented here.

FIG. 2 on the other hand shows the situation in which the vertical section 32 is displaced relative to the lintel section 31. In a manner which will be explained in more detail further below, the vertical section 32 is here displaceably mounted on the frame 2.

FIG. 2 further also shows a door leaf 6 of the lifting door 1 which is accommodated entirely in the vertical section 32 of the guide 3 in the position in accordance with FIG. 2. The door leaf 6 is mounted in the guide 3 and is thus displaced horizontally together with the vertical section 32 when the lifting door 1 passes into the position in accordance with FIG. 2. The displacing movement takes place perpendicularly to the plane of the door leaf, the latter being defined by the major surfaces, i.e., inner and outer surfaces of the door leaf in the closed condition. As a result the door leaf 6 presses against the sealing means 5 having the form of a tube seal in the present practical example. The sealing means 5 comprises frame sealing elements 51 which are fastened across the height of the door to the corresponding frame 2 on each side of the door opening, as well as a lintel sealing element 52 which is fastened to the door lintel. The two vertical frame sealing elements 51 and the horizontally extending lintel sealing element 52 are connected to each other by adhesive bonding so that the sealing means 5 is present as an integral element. No gap is therefore present even in the corner area at the abutting locations of the sealing elements 51 and 52, thus resulting in a reliable sealing effect. In the non-displaced position of the vertical section 32 or of the door leaf 6 in accordance with FIG. 1, on the other hand, the door leaf 6 is at a distance from the sealing means 5. Due to the pressure of the door leaf 6 onto the sealing means 5 in the position in accordance with FIG. 2, reliable sealing is obtained in this area.

As may moreover be taken from FIG. 2, the door leaf 6 comprises a plurality of slats 61 which each extend transversely across the door opening from one frame 2 to the other frame (not shown), and which are pivotally connected to each other. The slats 61 are mounted in the lateral guides 3 through respective guide rollers 62. Moreover the slats 61 are coupled to each other through hinge straps 63 provided on both sides adjacent the frames 2, whereby the driving force for operating the door leaf 6 is transmitted to the latter. The construction of the door leaf 6 and its interaction with the guides 3 is of a kind that is conventional per se and known, e.g., from the generic document DE 199 15 376 A1.

Figure 4:
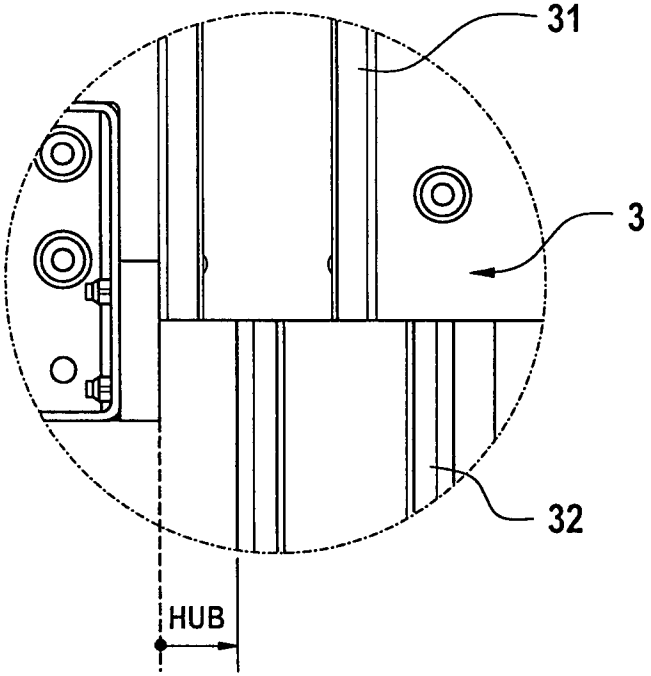
FIG. 4 is a representation similar to FIG. 3, where the vertical section of the guide has been displaced relative to the lintel section.
Figure 3:
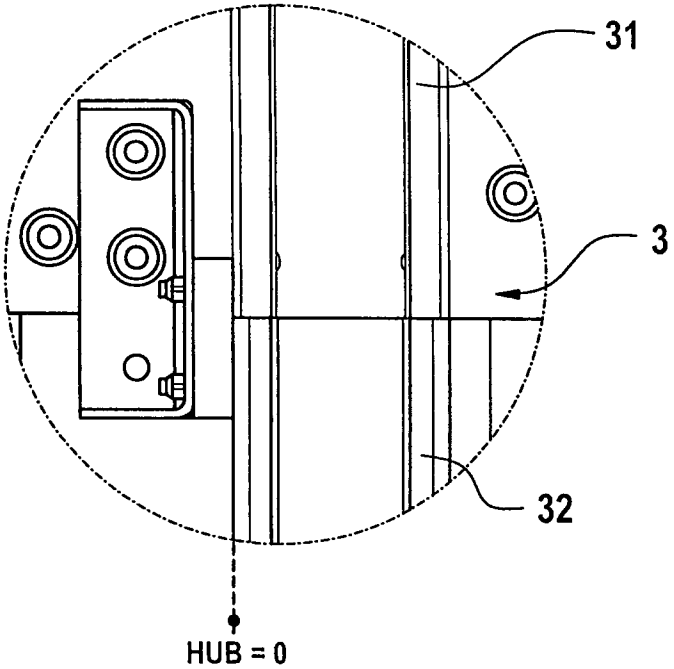
FIG. 3 is a detail view of the transitional area between the vertical section and the lintel section of the guide where the vertical section has not been displaced.

In FIG. 3 and FIG. 4 the transitional area between the lintel section 31 and the vertical section 32 of the guide 3 is shown in more detail. In the representation in accordance with FIG. 3 the vertical section 32 is in its basic position, i.e., it is not displaced in a direction toward the outer side of the door relative to the lintel section. The lintel section 31 and the vertical section 32 of the guide 3 thus are aligned, so that the door leaf may be moved from one guide section into the other one.

FIG. 4 on the other hand shows the situation where the vertical section 32 is displaced, where the door leaf 6 is received entirely in the vertical section 32. Owing to the displacement the door leaf 6 is prevented from passing over into the lintel section 31. The measure of displacement is designated by HUB [STROKE] in FIG. 3 and FIG. 4. In FIG. 3 HUB=0 as no displacement is present here, whereas FIG. 4 specifies a displacement by a predetermined measure.

Figure 6:
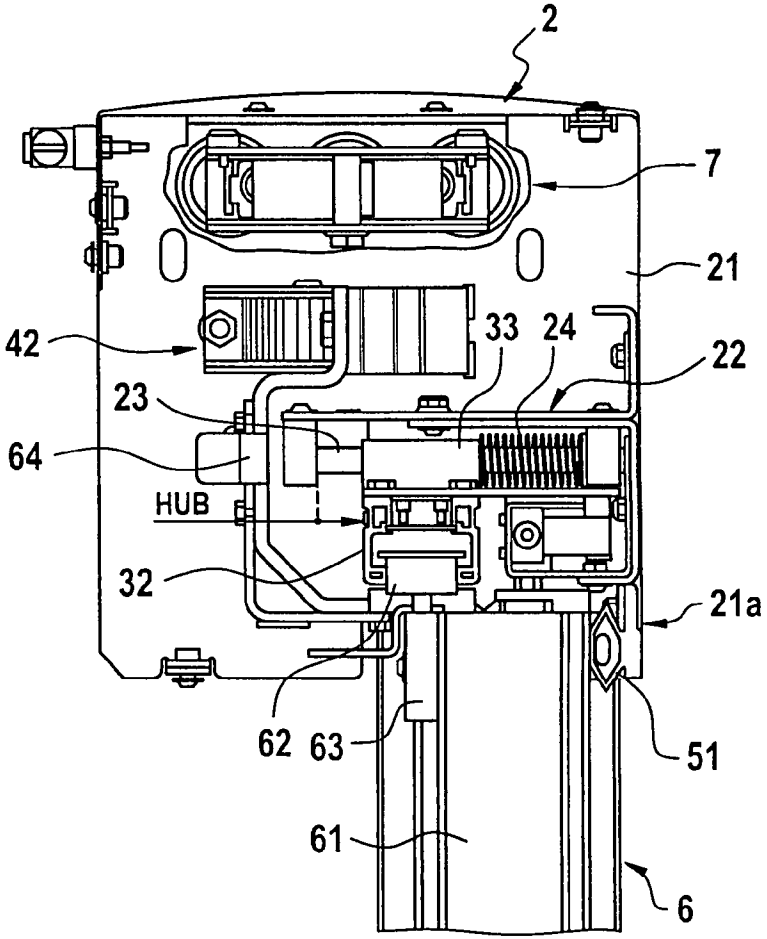
FIG. 6 is a representation similar to FIG. 5 wherein, however, the vertical section of the guide together with the door leaf has been displaced in a direction toward the outer side of the door.
Figure 5:
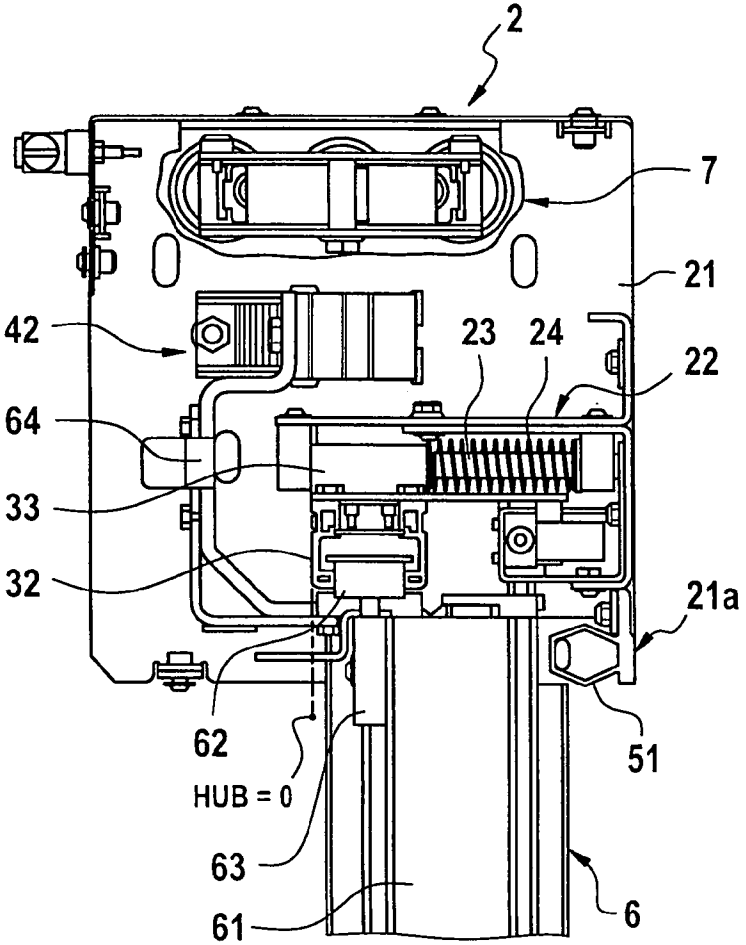
FIG. 5 is a top view of the lifting door in accordance with the invention, where the vertical section has not been displaced.

FIG. 5 and FIG. 6 show top views of a frame 2 with an adjacent door leaf 6, wherein an upper cover plate of the frame 2 has equally been left away. FIG. 5 again shows the condition with HUB=0, i.e., with the vertical section 32 not being displaced, whereas FIG. 6 represents the displaced position of the vertical section 32 by a predetermined measure for HUB. As is illustrated by these two representations, a moving gap is present between the sealing means 5 and the door leaf 6 while the vertical section 32 has not been displaced, so that the sealing means 5 is not subjected to any sliding wear during the movement of the door leaf 6. In contrast, in accordance with the representation in FIG. 6 the door leaf 6 presses against the sealing means 5 in the displaced position of the vertical section 32 and produces a reliable seal in the area of the lateral edges (and also in the lintel area) of the door opening.

FIG. 5 and FIG. 6 additionally show further components of the lifting door 1. E.g., a frame housing 21 of the frame 2 is visible in them. Furthermore a section 21*a* of the frame 2 facing the door opening is designated on which a frame sealing element 51 of the sealing means 5 is fixed. Inside the frame 2 there is moreover a weight balancing means 7, of which particularly the spring arrangement is visible in a top view in these figures.

In addition, within the frame 2 there is a belt drive 42 of the drive unit 4 whereby the driving force of the motor 41 is transmitted to the door leaf 6. To this end, the belt drive 42 cooperates with a door leaf reception 64 at the door leaf 6 which attacks at the lower end of the door leaf 6 in the area of the termination element thereof or of an adjacent slat 61.

In addition, in FIG. 5 and FIG. 6 a linear guide 22 for the vertical section 32 of the guide 3 is shown. The vertical section 32 is displaceably mounted on a mounting shaft 23 of the linear guide 22 by means of a mounting bush 33. On the mounting shaft 23 a reset spring 24 having the form of a compression spring is moreover placed which counteracts a displacement of the vertical section 32 in a direction toward the outer side of the door and thus causes the vertical section 32 to be reset into an aligned position with the lintel section 31 when the actuation mechanism is released. In FIG. 5 and FIG. 6 the displacement of the vertical section 32 is also visible in the area of the linear guide 22.

Such a linear guide 22 is arranged at the frame 2 in a least two locations across the height of the door. Corresponding linear guides 22 are also present in the opposite frame in mirror symmetry. In order to prevent the vertical section 32 from jamming while being displaced and particularly with greater door heights, more than two linear guides 22 are moreover provided for each door side.

Figure 8:
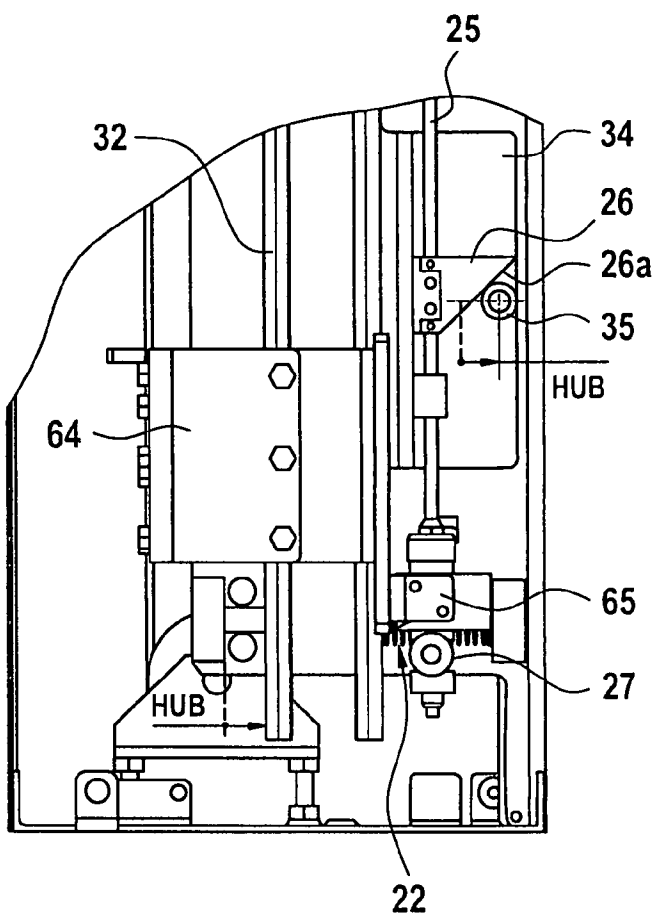
FIG. 8 is a representation similar to FIG. 7, where the vertical section of the guide has been displaced toward the outer side of the door.
Figure 7:
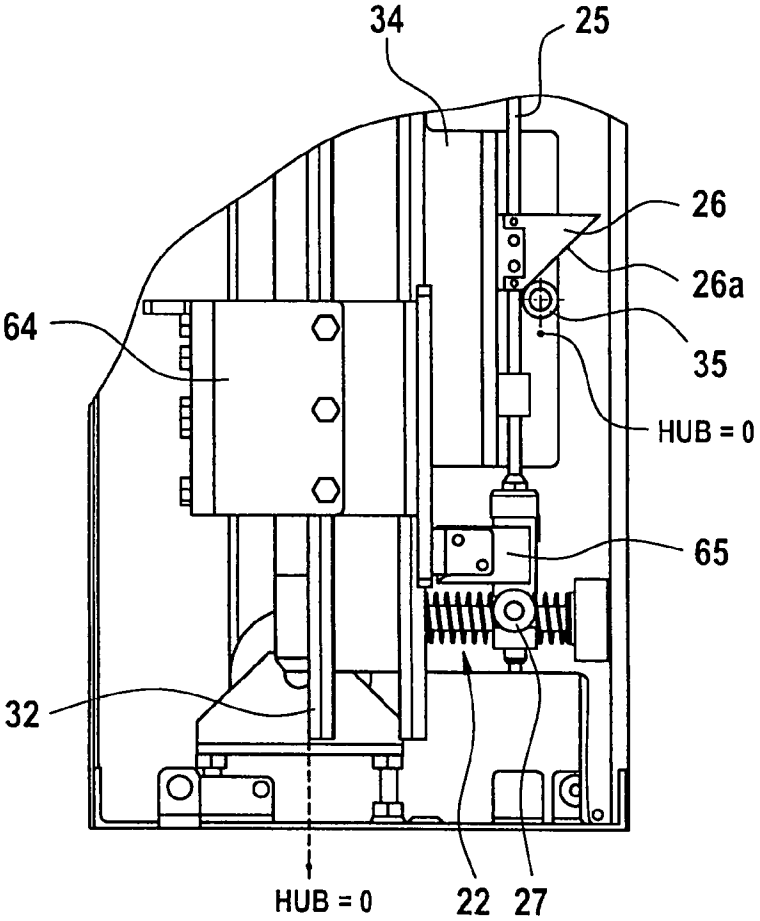
FIG. 7 shows a detail of a lateral view of the lifting door in accordance with the invention in the area of its floor contact surface, where the vertical section of the guide has not been displaced.

FIG. 7 and FIG. 8 show more details with regard to the actuation mechanism whereby the displacement of the vertical section 32 in each frame is made possible. In the present embodiment this displacement is initiated or controlled by the movement of the door leaf 6. To this effect an actuation rod 25 extending vertically across the height of the door and mounted at the frame 2 at the top and bottom ends of the door opening is present in the area of each lateral frame 2. On this actuation rod 25 several actuation blocks 26 are fastened which present an oblique guide surface 26*a*. The actuation blocks 26 cooperate with a deflection roller support 34 which is fastened at the vertical section 32 and carries a deflection roller 35. The deflection roller 35 rolls on the oblique guide surface 26*a* of a actuation block 26 while the displacement of the vertical section 32 is established and cancelled.

The displacing movement is initiated by the door leaf reception 64 which has a pressing portion 65. While the door leaf 6 is being closed and briefly before the fully closed position is reached, this pressing portion presses a roller 27 which is mounted at the lower end of the actuation rod 25. The actuation rod 25 is mounted in the frame 2 so as to be slidable in its longitudinal direction, so that due to the action of the pressing portion 65 it is urged downward toward the floor contact surface. This initiates a rolling movement of the deflection roller 35 along the oblique guide surface 26*a* whereby in the final phase of movement the door leaf 6 is moved not only in a downward direction but at the same time also in a direction toward the outer side of the door.

Figure 9:
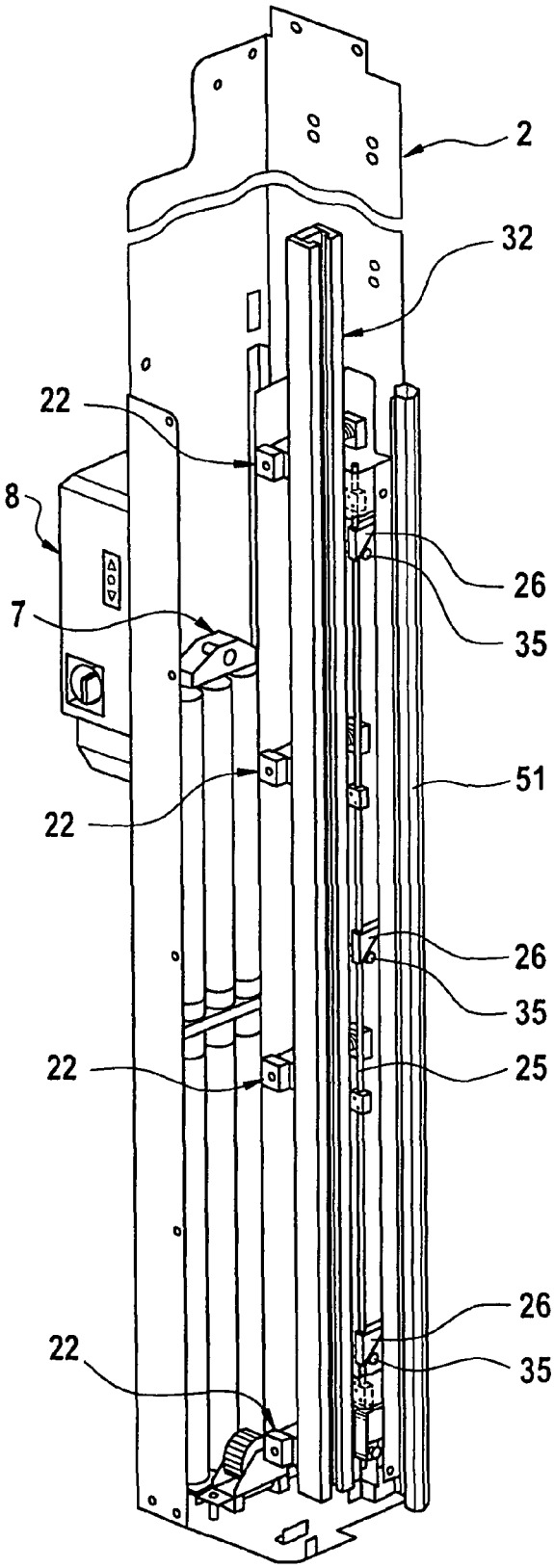
FIG. 9 is a schematic perspective view of a frame area on the lifting door in accordance with the invention.

In FIG. 9 a schematic perspective view of a frame 2 is shown. From this a control unit 8 for controlling the operation of the lifting door 1 is furthermore evident. In particular FIG. 9 does, however, show four linear guides 22 for a vertical section 32. This serves to avoid jamming of the vertical section 32. In addition three actuation mechanisms having a corresponding number of actuation blocks 26 and deflection rollers 35 are furthermore visible in FIG. 9. The displacement force introduced through the actuation rod 25 is accordingly transmitted to the vertical section 32 of the guide 3 in three locations.

Figure 10:
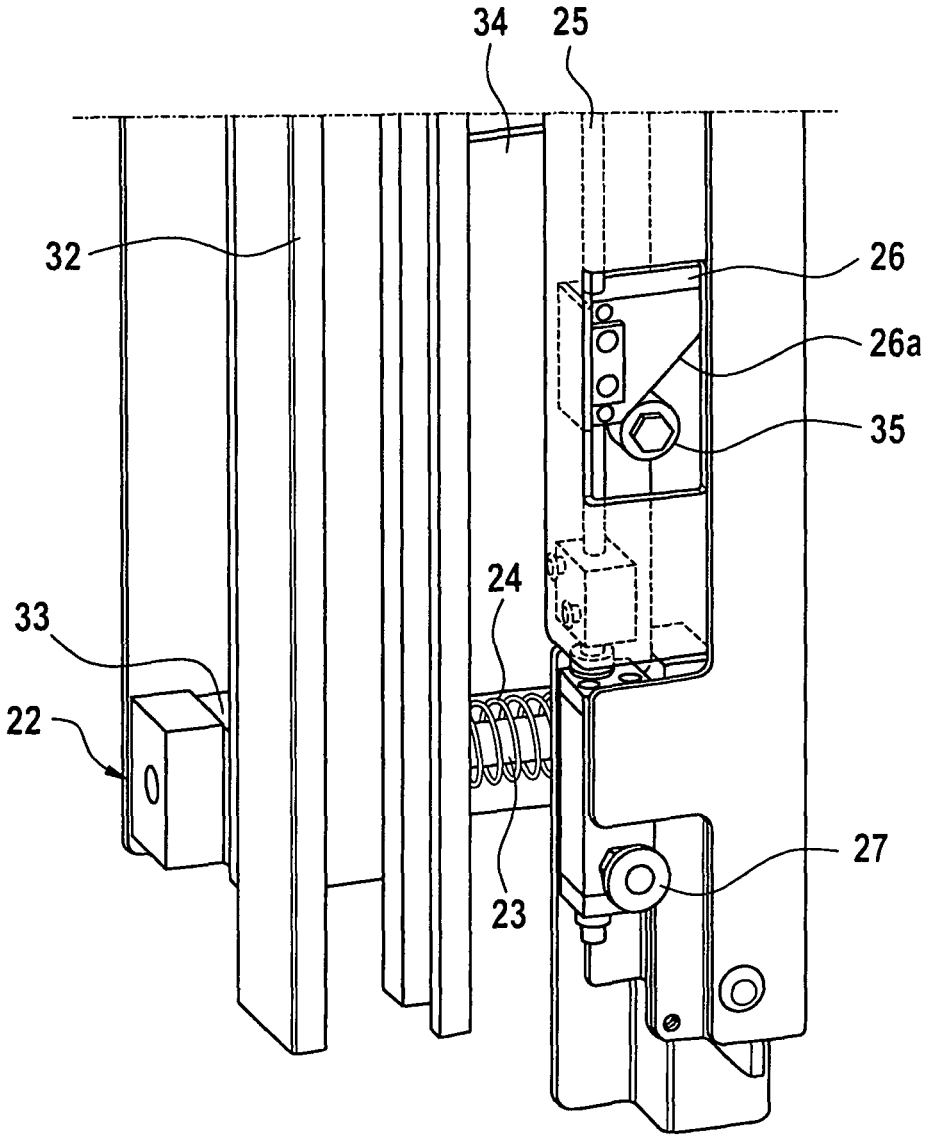
FIG. 10 is a detail view of the mount of the vertical section of the guide at the frame.

FIG. 10 shows an actuation mechanism in more detail, with particularly the actuation rod 25, its mount, and the roller 27 also each being clearly visible. The pressing portion 65 at the door leaf reception 64 acts on the roller 27 to push it downward, so that the actuation rod 25 as a whole is pulled downward.

FIG. 10 also shows a linear guide 22 in more detail. As may be seen here, the vertical section 32 is fixedly connected to the mounting bush 33 which is slidingly displaceable on the mounting shaft 23. The reset spring 24 causes the vertical section 32 to be reset as soon as the pressure on the roller 27 is released and the actuation rod 25, which is also biased elastically in the opposite direction, again returns into its rest position. Hereby the actuation blocks 26 together with the actuation rod 25 are displaced upwardly in such a way that the deflection rollers 35 roll on the oblique guide surface 26*a* in the opposite direction and the vertical section 32 may return to its starting position.

Figure 11:
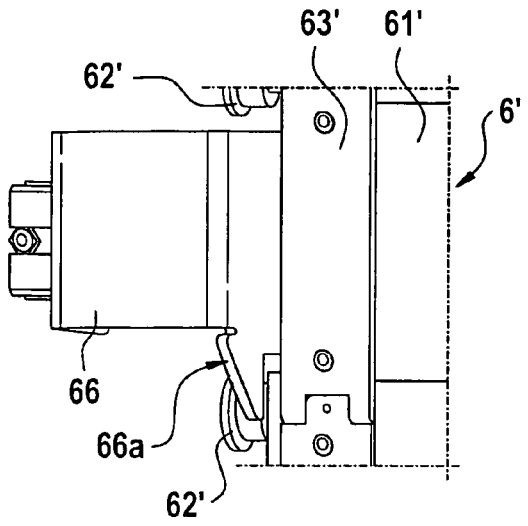
FIG. 11 is a schematic perspective representation of a lower actuation reception for an actuation mechanism in accordance with a second embodiment.
Figure 12:
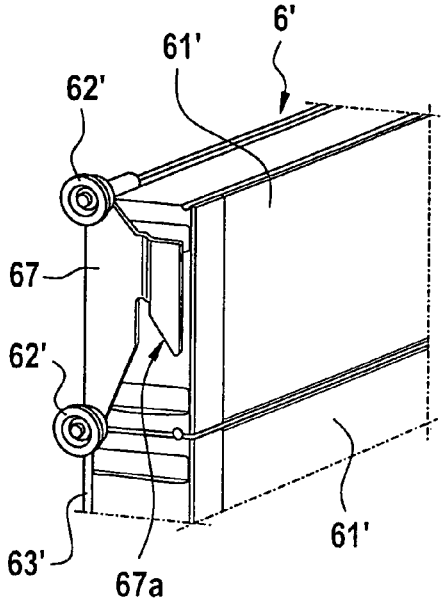
FIG. 12 is a schematic perspective view of an upper actuation reception for an actuation mechanism in accordance with the second embodiment.
Figure 13:
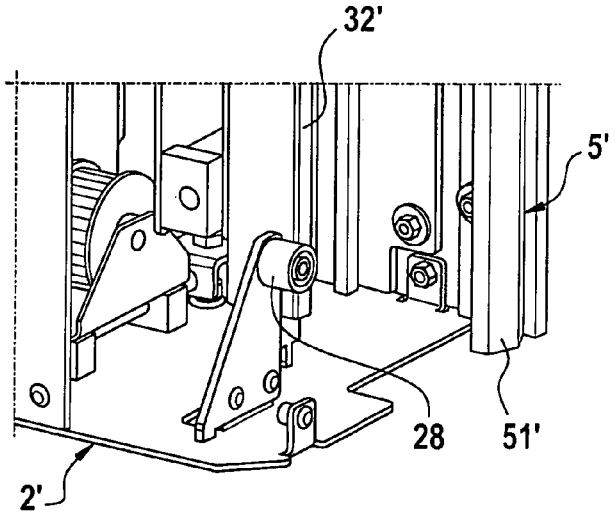
FIG. 13 is a schematic perspective view of a lower guide roller for the actuation mechanism in accordance with the second embodiment.
Figure 14:
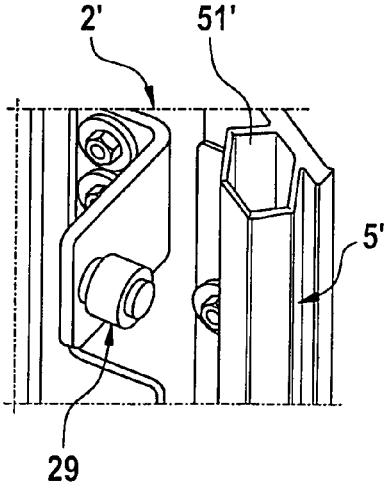
FIG. 14 is a schematic perspective view of an upper guide roller for the actuation mechanism in accordance with the second embodiment.

In FIGS. 11 through 14 an alternative embodiment for an actuation mechanism is represented. In this embodiment an actuation rod is omitted, with the force for a displacement of the vertical section of the guide being introduced at the top and bottom ends of a door leaf 6'. To this end, actuation receptions are arranged in these locations, with FIG. 11 showing a lower actuation reception 66 and FIG. 12 an upper actuation reception 67. Each of these includes oblique guide surfaces 66*a* and 67*a* which cooperate with guide rollers fixedly fastened to a frame 2'. FIG. 13 shows a lower guide roller 28, and FIG. 14 shows an upper guide roller 29.

While the door leaf 6' is being closed, the oblique guide surface 66*a* of the lower actuation reception 66 engages the lower guide roller 28 which then rolls thereon. Substantially at the same time the oblique guide surface 67*a* of the upper actuation reception 67 engages the upper guide roller 29 which equally rolls on it. This results in a displacement of the door leaf 6' relative to the frame 2', so that the door leaf 6' together with a vertical section 32' is moved in a direction toward the outer side of the door. In this second embodiment the vertical section 32' is thus displaced horizontally in an indirect manner through the door leaf 6' as it is driven by the guide rollers 62' mounted on slats 61' or hinge straps 63'. This also has the effect of a frame sealing element 51' of the sealing means 5' as shown in FIG. 13 and FIG. 14 being compressed in the closed condition of the lifting door, whereby a reliable seal is obtained in this area.

Apart from this the vertical section 32' is mounted on the frame 2' in a substantially identical manner by means of linear guides such as the linear guides 22 of the first embodiment, whereby jamming of the door leaf 6' or of the vertical section 32' is avoided.

Besides the discussed embodiments the invention allows for additional design approaches.

Thus it is also possible to employ other types of actuation mechanisms for initiating the displacement of the vertical section 32 or 32', as long as a reliable operation of the lifting door 1 is made possible.

Apart from this it is, however, also possible to employ separate drive means instead of the discussed actuation mechanisms and to make the displacement of the vertical sections of the guides at the frames independent of the movement of the door leaf. Such drive means might, for example, be motor operators or power-driven separate actuation members of some other type, whereby a displacing movement on the vertical section or the door leaf is initiated in a predetermined number of more than two locations across the height of the door. Such a separate drive means may be operated by the same control unit as the lifting door 1 per se, or also by a separate control unit provided in addition thereto and preferably connected thereto in terms of control technology.

In the shown practical example the lintel section 31 has the form of a spiral section. This is, however, not mandatory; it is rather not crucial for the present invention in what form the door leaf is received in the door lintel area. Thus, a simple deflection of the door leaf in parallel with the ceiling of the room might be effected, with the door leaf then being guided along the ceiling.

The lifting door in accordance with the invention may moreover also be realized without the lintel sealing element 52, with the sealing means 5 or 5' then merely comprising the two lateral frame sealing elements 51 or 51'. In this case a door lintel sealing means in accordance with DE 10 2008 007 592 A1 may alternatively be provided. This equally serves to obtain a reliable sealing effect not only in the area of the lateral frames but also in the door lintel area.

The invention claimed is:

1. A lifting door comprising a movable door leaf and building-mounted frames disposed on either side of a door opening, wherein mutually facing, lateral guides for the door leaf are arranged at the frames, the lateral guides comprising a vertical section and a lintel section, wherein the door leaf is formed of slats pivotally connected to each other and in the closed condition covers the door opening, wherein the door leaf is guided in the lateral guides such as to be accommodated in the lintel sections in the opened state of the lifting door and in the vertical sections of the guides in the closed condition of the lifting door, wherein the vertical sections of the guides are mounted on the frames so as to be displaceable, whereby in the closed condition of the lifting door-the door leaf may be displaced in a direction toward the outer side of the door, and wherein the lifting door further comprises a drive unit for operating the door leaf, frame sealing elements of a seal are furthermore arranged at the frames, wherein in the closed condition of the lifting door the door leaf presses against the seal, wherein a frame-side actuator initiates the displacement of the vertical sections of the guides by contacting a plurality of displacement mechanisms, the plurality of displacement mechanisms including a plurality of deflection rollers, and the vertical sections of the guides are mounted on the frames so as to be displaceable perpendicularly to the plane of the door leaf and fixed in the direction of vertical movement of the door leaf, wherein the actuator comprises an actuation rod and a plurality of actuation blocks having guide surfaces, wherein the plurality of deflection rollers rollingly engage the guide surfaces concurrently to transmit linear horizontal force at multiple locations of the vertical sections of the guides to displace the guides perpendicularly to the plane of the door leaf.

2. The lifting door according to claim 1, wherein the seal further comprises a lintel sealing element.

3. A frame which guides movement of a lifting door leaf between an open and closed position, the frame comprising:

a guide which guides the lifting door leaf, the guide having a vertical section and a lintel section, at least a portion of the vertical section in a plane which is parallel to a vertical plane formed by a vertical section of the lifting door leaf;

a plurality of displacement mechanisms, the plurality of displacement mechanisms including a plurality of deflection rollers;

a frame-side actuator, the frame-side actuator including an actuation rod and a plurality of actuation blocks having guide surfaces, wherein the plurality of deflection rollers rollingly engage the guide surfaces concurrently to transmit linear horizontal force at multiple locations of the vertical section of the guide to displace the vertical section perpendicularly to the vertical plane of the lifting door leaf;

wherein the vertical section of the guide is displaceable perpendicularly to the vertical plane of the lifting door leaf when the lifting door leaf is in the closed position and fixed in the direction of movement of the door leaf when the door leaf is in the closed position.

4. A guide which guides movement of a lifting door between an open and closed position, the lifting door in a vertical plane when in the closed position, the guide comprising:

a lintel section which houses the lifting door in a spiral configuration when the lifting door is in the open position;

a vertical section, the vertical section being displaced relative to the lintel section and being displaced perpendicularly to the vertical plane of the lifting door when the lifting door is in the closed position, and the vertical section also being fixed in the direction of movement of the lifting door when the lifting door is in the closed position;

an actuation rod comprising a plurality of actuation blocks having guide surfaces; and a plurality of displacement mechanisms in a vertical spaced apart relation, the plurality of displacement mechanisms including a plurality of deflection rollers that rollingly engage the guide surfaces of the actuation blocks;

wherein vertical movement of the actuation rod horizontally displaces the plurality of deflection rollers concurrently along the guide surfaces of the actuation blocks to displace the vertical section perpendicularly to the vertical plane of the lifting door when the lifting door is in the closed position.

5. A method for closing a gap at a lifting door, which gap is present between a door leaf and a section facing a door opening of frames on which frame sealing elements of a seal are arranged, wherein mutually facing, lateral guides for the door leaf comprising a vertical section and a lintel section are arranged at the frames, wherein the door leaf is formed of slats pivotally connected to each other and in the closed condition covers the door opening, and wherein the door leaf is guided in the lateral guides such as to be accommodated in the lintel sections in the opened state of the lifting door and in the vertical sections of the guides in the closed condition of the lifting door, the method comprising the steps of:

moving the door leaf into its closing position, and displacing the vertical sections of the guides perpendicularly to the plane of the door leaf during the closing movement or after it in a direction toward the outer side of the door, without a movement of the vertical sections in the direction of vertical movement of the door leaf, whereby the door leaf is urged against the seal, the displacing the vertical sections of the guides comprising transferring a force from an actuation rod to a plurality of displacement mechanisms concurrently, the actuation rod including a plurality of actuation blocks having guide surfaces, the plurality of displacement mechanisms including a plurality of deflection rollers, and the transferring the force from the actuation rod to the plurality of displacement mechanisms concurrently comprises rollingly engaging the plurality of deflection rollers and the guide surfaces of the actuation blocks concurrently to transmit linear horizontal force at multiple locations of the vertical sections of the guides.

6. A lifting door comprising:

a plurality of frames disposed proximal a door opening, the plurality of frames comprising a seal;

a door leaf comprising a plurality of pivotally connected slats;

a drive unit operatively connected to the door leaf and which moves the door leaf between an open and closed position, the door leaf in a vertical plane when in the closed position;

a plurality of door leaf guides comprising a vertical section and a lintel section, the vertical section being displaceable perpendicularly to the vertical plane of the door leaf and fixed in the direction of vertical movement of the door leaf when the door leaf is in the closed position;

an actuation mechanism coupled to the frame and slidable in a vertical direction, the actuation mechanism including an actuation rod and a plurality of actuation blocks having guide surfaces;

a plurality of vertically spaced displacement mechanisms, the plurality of vertically spaced displacement mechanisms including a plurality of deflection rollers which rollingly engage the guide surfaces of the plurality of actuation blocks when the door leaf moves to the closed position, wherein the actuation mechanism transfers a force to the plurality of vertically spaced displacement mechanisms concurrently when the actuation mechanism is urged in the downward direction such that the door leaf is urged in the horizontal direction at a plurality of vertically spaced positions.

7. A frame which guides movement of a lifting door leaf between an open and closed position, the frame comprising:

a guide which guides the lifting door leaf, the guide having a vertical section and a lintel section;

at least one linear guide operatively connected to the vertical section of the guide to permit movement of the vertical section in a horizontal direction and to fix movement of the vertical section in a vertical direction;

a frame-side actuator, the frame-side actuator including an actuation rod movable in the vertical direction and a plurality of actuation blocks connected to the actuation rod, the plurality of actuation blocks having guide surfaces;

a plurality of displacement mechanisms, the plurality of displacement mechanisms including deflection rollers which rollingly engage the guide surfaces of the plurality of actuation blocks, the actuation rod transmitting a force to the plurality of displacement mechanisms concurrently when the lifting door moves to the closed position, the force causing displacement of the plurality of displacement mechanisms in the horizontal direction and effecting movement of the vertical section of the guide in the horizontal direction when the lifting door leaf moves to the closed position.

8. The frame according to claim 7, wherein the at least one linear guide comprises a mounting shaft and a spring.

9. The frame according to claim 8, wherein the at least one linear guide is operably connected to the vertical section of the guide by a mounting bush, the mounting bush connected to the vertical section and slidably displaceable on the mounting shaft.

10. The frame according to claim 7, wherein the guide surfaces of the plurality of actuation blocks comprise an oblique guide surfaces.

11. The lifting door according to claim 1, wherein the guide surfaces of the plurality of actuation blocks comprise oblique guide surfaces along which the deflection rollers rollingly engage.

12. The frame according to claim 3, wherein the guide surfaces of the plurality of actuation blocks comprise oblique guide surfaces along which the deflection rollers rollingly engage.

13. The guide according to claim 4, wherein the guide surfaces of the plurality of actuation blocks comprise oblique guide surfaces along which the deflection rollers rollingly engage.

14. The method according to claim 5, wherein rollingly engaging the plurality of deflection rollers and the guide surfaces of the actuation blocks concurrently comprises rollingly engaging the plurality of deflection rollers along oblique guide surfaces.

15. The lifting door according to claim 6, wherein the guide surfaces of the plurality of actuation blocks comprise oblique guide surfaces along which the deflection rollers rollingly engage.

* * * * *

UNITED STATES PATENT AND TRADEMARK OFFICE

CERTIFICATE OF CORRECTION

PATENT NO. : 9,097,062 B2
APPLICATION NO. : 13/580592
DATED : August 4, 2015
INVENTOR(S) : Jure Letonje, Andrej Mazej and Janez Küzmic It is certified that error appears in the above-identified patent and that said Letters Patent is hereby corrected as shown below:

On the Title Page:

Item (73), under "Assignee", in column 1, line 1, delete "Inzeniring" and insert --Inženiring--, therefor.

Item (73), under "Assignee", in column 1, line 2, delete "Ljublana" and insert --Ljubljana--, therefor.

In the Specification:

Before column 6, line 22, insert heading --BRIEF DESCRIPTION OF DRAWINGS--.

Before column 7, line 4, insert heading --DETAILED DESCRIPTION--.

In column 7, line 9, delete "wile" and insert --while--, therefor.

In the Claims:

Column 11, line 10, in claim 1, delete "door-the" and insert --door, the--, therefor.

Signed and Sealed this
Sixteenth Day of August, 2016

Michelle K. Lee

Michelle K. Lee
*Director of the United States Patent and Trademark Office*